US009239162B2

(12) United States Patent
Sawarynski, Jr.

(10) Patent No.: US 9,239,162 B2
(45) Date of Patent: Jan. 19, 2016

(54) LINER FOR PREVENTING AIRFLOW THROUGH A RECESSED LIGHT AND A METHOD FOR INSTALLING THE LINER

(71) Applicant: Third Shore Group, LLC, Royal Oak, MI (US)

(72) Inventor: Thomas J. Sawarynski, Jr., West Bloomfield, MI (US)

(73) Assignee: Versicor, LLC, Royal Oak, MI (US)

( * ) Notice: Subject to any disclaimer, the term of this patent is extended or adjusted under 35 U.S.C. 154(b) by 113 days.

(21) Appl. No.: 13/931,456

(22) Filed: Jun. 28, 2013

(65) Prior Publication Data

US 2014/0003065 A1 Jan. 2, 2014

Related U.S. Application Data

(60) Provisional application No. 61/666,072, filed on Jun. 29, 2012.

(51) Int. Cl.

| | |
|---|---|
| ***F21S 8/02*** | (2006.01) |
| ***F21V 31/00*** | (2006.01) |
| ***F21V 21/04*** | (2006.01) |

(52) U.S. Cl.

CPC ..... *F21V 31/005* (2013.01); *F21S 8/026* (2013.01); *F21V 21/04* (2013.01); *Y10T 29/49817* (2015.01)

(58) Field of Classification Search

CPC ..... F21V 31/005; F21V 21/04; F21V 33/00; F21S 8/026; F21S 8/02; Y10T 29/49817

USPC ..... 362/147, 267, 364, 365, 264, 265, 366; 29/426.2

See application file for complete search history.

(56) References Cited

U.S. PATENT DOCUMENTS

| | | | | |
|---|---|---|---|---|
| 7,208,677 | B2 * | 4/2007 | Moselle | 174/50 |
| 7,500,766 | B1 * | 3/2009 | Reynolds | 362/364 |
| 7,651,238 | B2 * | 1/2010 | O'Brien | 362/147 |
| 2006/0023450 | A1 | 2/2006 | Chung et al. | |
| 2007/0183154 | A1 | 8/2007 | Robson | |
| 2007/0206374 | A1 | 9/2007 | Petrakis | |
| 2010/0208471 | A1 * | 8/2010 | Sell | 362/365 |
| 2011/0157900 | A1 | 6/2011 | Garner | |

* cited by examiner

*Primary Examiner* — Y M. Lee

(74) *Attorney, Agent, or Firm* — Harness, Dickey & Pierce, P.L.C.

(57) ABSTRACT

A recessed light liner assembly according to the principles of the present disclosure includes a hollow body and an annular flange. The hollow body is configured to fit within the recessed light to prevent airflow through the recessed light, the body having an open bottom, a closed top, and a sidewall extending between the open bottom and the closed top. The annular flange is connected to the body and extends around the open bottom of the body.

18 Claims, 4 Drawing Sheets

LINER FOR PREVENTING AIRFLOW THROUGH A RECESSED LIGHT AND A METHOD FOR INSTALLING THE LINER

CROSS-REFERENCE TO RELATED APPLICATIONS

This application claims the benefit of U.S. Provisional Application No. 61/666,072, filed on Jun. 29, 2012. The entire disclosure of the above application is incorporated herein by reference.

FIELD

The present disclosure relates to recessed lights, and more particularly, to liners for significantly reducing airflow through a recessed light and to methods for installing the liners.

BACKGROUND

This section provides background information related to the present disclosure which is not necessarily prior art.

A recessed light is a light fixture that is installed into an opening in a ceiling. When the recessed light is installed, the recessed light provides the appearance of light shining from a hole in the ceiling. The light is concentrated in a downward direction as a broad floodlight or a narrow spotlight.

A recessed light includes housing and trim. The housing can be mounted between ceiling joists. Alternatively, the housing can be mounted directly to the ceiling, which may occur when the recessed light is retrofitted to an existing ceiling. The housing contains a lamp holder for holding a light bulb and providing electricity to the light bulb. The trim is typically a ring that fits within the opening in the ceiling and extends around the light bulb to hide the housing.

Air may leak through a recessed light between a conditioned space of a building and an unconditioned space of the building, especially if the recessed light is older. Older recessed lights are typically very porous, and newer lights typically provide a better seal or barrier. However, even some newer, inexpensive recessed lights may not be sealed well.

Liners have been developed that can be retrofitted in a recessed light to prevent airflow through the recessed light. However, these liners require mounting hardware such as screws and brackets, and are therefore costly and difficult to install. Therefore, a need exists for a liner that has a simple design and is easy to install.

SUMMARY

This section provides a general summary of the disclosure, and is not a comprehensive disclosure of its full scope or all of its features.

A recessed light liner assembly according to the principles of the present disclosure includes a hollow body and an annular flange. The hollow body is configured to fit within the recessed light to prevent airflow through the recessed light, the body having an open bottom, a closed top, and a sidewall extending between the open bottom and the closed top. The annular flange is connected to the body and extending around the open bottom of the body.

In one aspect, the recessed light liner assembly also includes a flange sealing gasket. The flange sealing gasket is configured to attach the flange to an underside surface of a ceiling to secure the body within the recessed light. The flange sealing gasket is also configured to provide a seal between the flange and the underside surface of the ceiling. In another aspect, the closed top of the body defines a punch-out portion configured to be punched through without using a cutting tool.

The present disclosure further provides a method for installing a liner into a recessed light, where the recessed light includes housing and trim, and the liner includes a body and a flange. The method includes disassembling the trim from the housing and inserting the liner into the housing. The method also includes passing a light bulb socket through the body of the liner, attaching the flange of the liner to an underside surface of a ceiling, and reassembling the trim to the housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
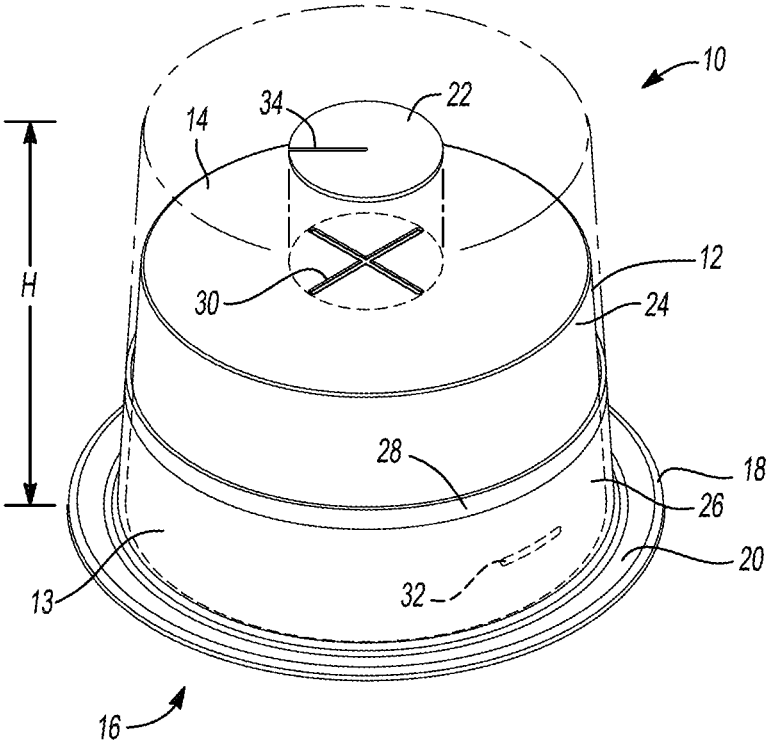
FIG. 1 is a perspective view of a liner assembly according to the principles of the present disclosure.
Figure 2:
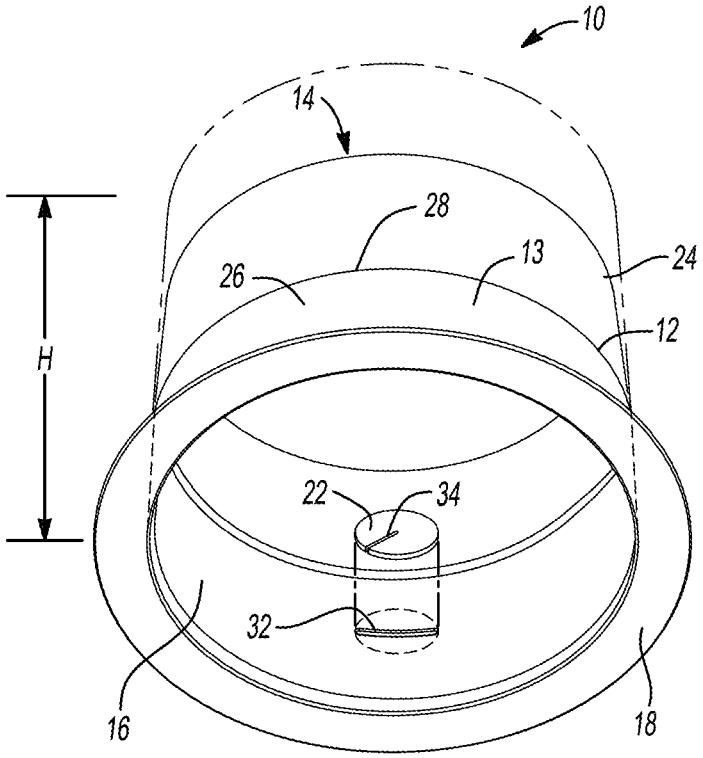
FIG. 2 is a perspective view of the liner assembly of FIG. 1 illustrating the interior of the liner assembly.

Referring to FIGS. 1 and 2, a liner assembly 10 is configured to be installed into a recessed light to significantly reduce airflow through the recessed light. The liner assembly 10 includes a hollow body 12 having a sidewall 13 extending between a closed top 14 and an open bottom 16, an annular flange 18 extending around the open bottom 16, a flange sealing gasket 20, and body sealing gaskets 22. The body 12 and the flange 18 can be unitarily formed from a material that is suitable for the operating conditions to which the liner assembly 10 is exposed such as a high temperature resistant material. For example, the body 12 and the flange 18 can be integrally, injection molded from liquid silicon rubber using dual cavity molds. Alternatively, the body 12 and the flange 18 can be integrally formed from a nylon polymer membrane using vacuum forming.

The flange sealing gasket 20 is configured to attach the flange 18 to an underside surface of a ceiling when the body 12 of the liner assembly 10 is inserted into a recessed light. In this regard, the flange sealing gasket 20 can be coated with an adhesive so that one side of the flange sealing gasket 20 adheres to the flange 18 while the other side of the flange sealing gasket 20 adheres to the ceiling. In addition, the flange sealing gasket 20 is configured to seal the interface between the flange 18 and the ceiling. To this end, the flange sealing gasket 20 can be formed from a high temperature resistant butyl rubber or similar material.

Figure 3:
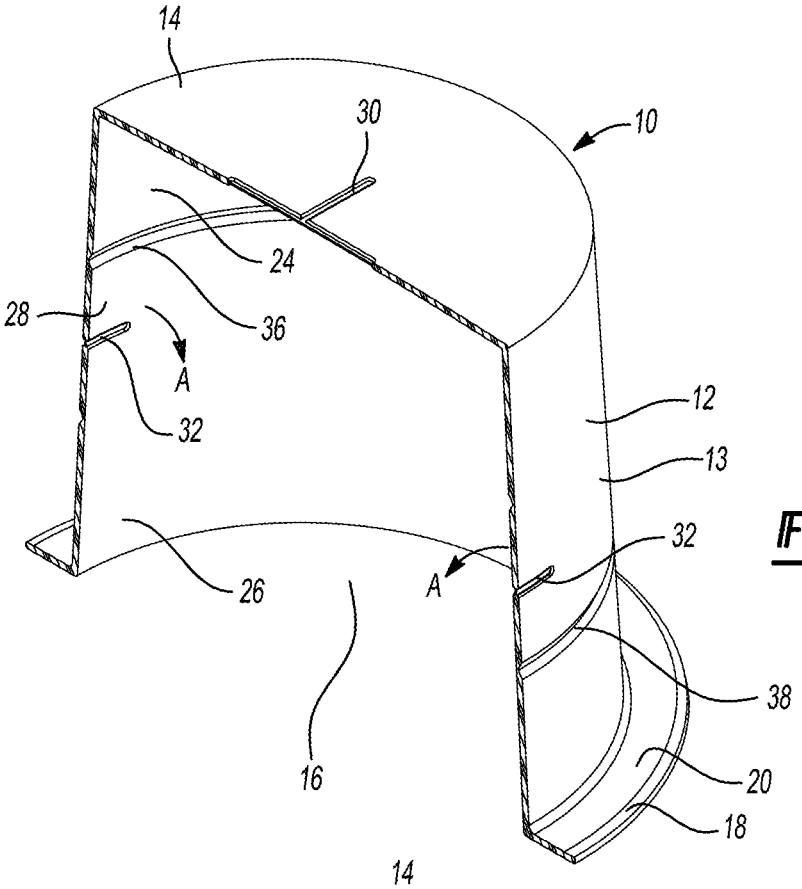
FIG. 3 is a sectioned perspective view of a portion of the liner assembly of FIG. 1.
Figure 4:
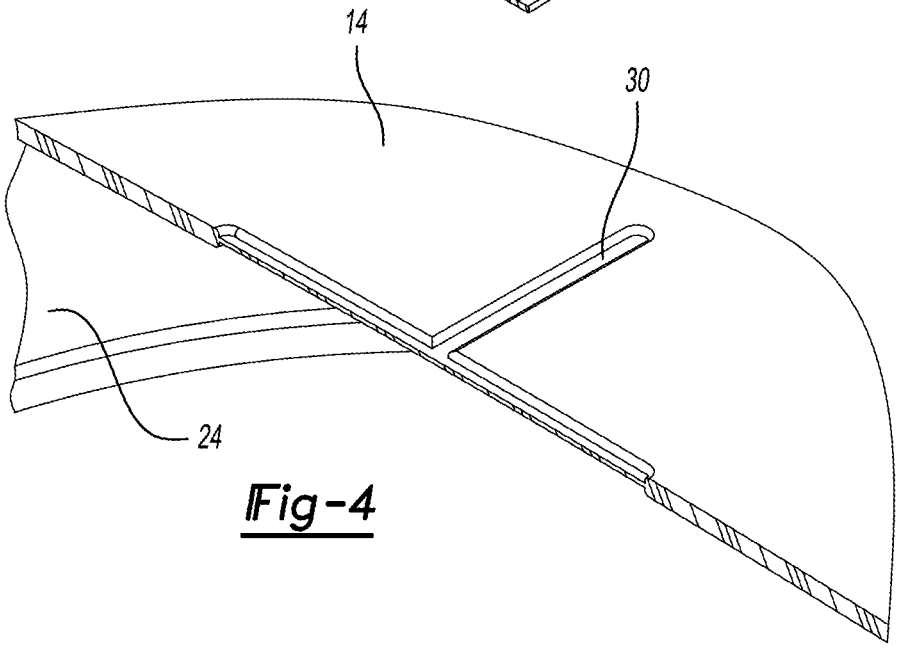
FIG. 4 is a sectioned perspective view of a portion of the liner assembly of FIG. 1 illustrating a punch-out for wiring and/or a light socket.

With additional reference to FIGS. 3 and 4, the sidewall 13 of the body 12 can include a first portion 24, a second portion 26, and a collapsible portion 28 disposed between the first and second portions 24, 26. The collapsible portion 28 is configured to be collapsed or unfolded to adjust a height H of the liner assembly 10 to fit the liner assembly 10 within recessed lights of various depths. In addition, the collapsible portion 28 can be collapsed to reduce the space required for the liner assembly 10 during shipping, storage, and retail display. The collapsible portion 28 is partially collapsed in FIGS. 1 and 2, and the collapsible portion 28 is fully unfolded in FIG. 3. Thus, the height H of the liner assembly 10 as shown in FIGS. 1 and 2 is less than the height H of the liner assembly 10 as shown in FIG. 3. When the collapsible portion 28 is fully unfolded as shown in FIG. 3, the body 12 has a frustum conical shape.

The body 12 can be formed to include a punch-out portion 30 for passing wiring and a light bulb socket through the liner assembly 10. The pass through portion 30 can be defined in the closed top 14. In addition, the body 12 can be formed to include one or more punch-out portions 32 for passing trim mounting hardware, such as coil springs, through the liner assembly 10. Some recessed lights may include mounting tabs that are formed as part of the recessed light can or housing, and coil springs or spring fingers may couple the recessed light trim to the mounting tabs. For these recessed lights, the mounting tabs can be passed through the punch-out portions 32. The pass through portions 32 can be defined in the collapsible portion 28, as shown, or in another portion of the body 12 such as the first or second portions 24, 26.

The punch-out portions 30, 32 are configured to be punched through using, for example, a blunt object, and without using a cutting tool. In this regard, the punch-out portions 30, 32 can be perforated, can have a reduced thickness relative to the remainder of the body 12, and/or can have a line-shaped or cross-shaped profile. In various implementations, the body 12 may not be formed to include the punch-out portions 30, 32, and a cutting tool may be used to create one or more slits in the body 12 to pass objects through the body 12.

As shown in FIG. 1, one of the sealing gaskets 22 can be placed on the exterior surface of the punch-out portion 30 after the wiring and the light-bulb socket have been passed through the punch-out portion 30. Similarly, as shown in FIG. 2, one of the sealing gaskets 22 can be placed on the interior surface of the punch-out portion 32 after the trim mounting hardware has been passed through the punch-out portion 32. Alternatively, the sealing gaskets 22 can be placed on the interior surface of the punch-out portion 30 and/or on the exterior surface of the punch-out portion 32.

The body sealing gaskets 22 are configured to seal the punch-out portions 30, 32 after the punch-out portions 30, 32 are punched out and objects are passed though the punch-out portions 30, 32. In this regard, the body sealing gasket 22 can be formed from a high temperature resistant butyl, and can define a slit 34 designed to receive objects that are passed through the punch-out portions 30, 32. At least one side of each of the body sealing gaskets 22 can be coated with an adhesive so that the body sealing gaskets 22 adhere to the punch-out portions 30, 32.

Figure 5:
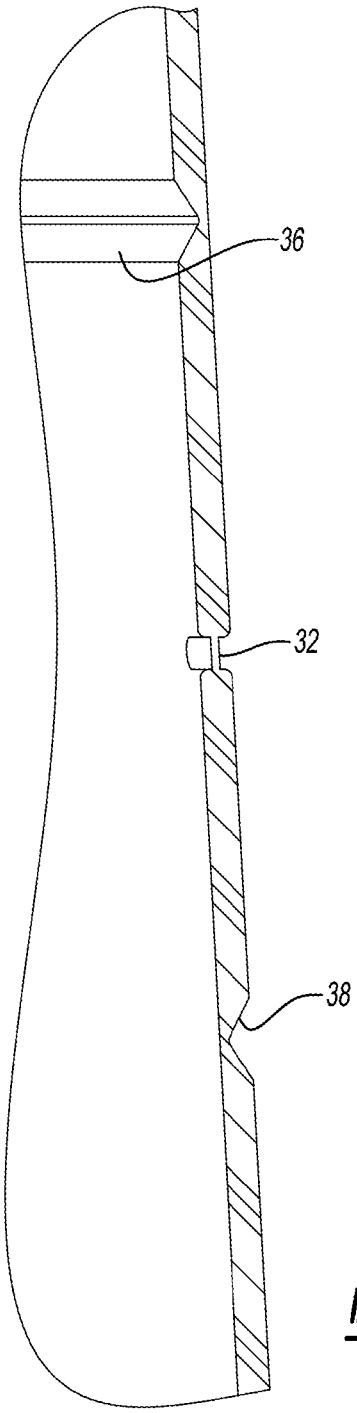
FIG. 5 is a cross-sectional view of a portion of the liner assembly of FIG. 1 illustrating a collapsible portion fully unfolded.
Figure 6:
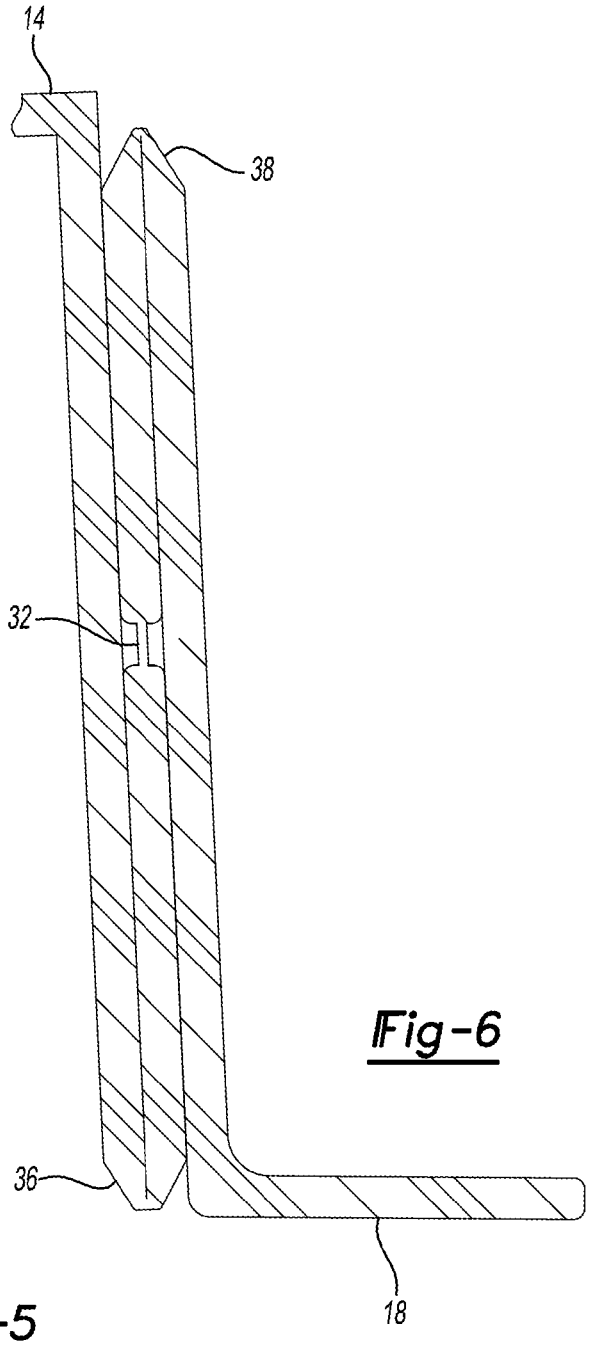
FIG. 6 is a cross-sectional view of a portion of the liner assembly of FIG. 1 illustrating the collapsible portion fully collapsed.

With additional reference to FIGS. 5 and 6, the interior surface of the body 12 can define a first groove 36, and the exterior surface of the body 12 can define a second groove 38. The first groove 36 is disposed between the first portion 24 and the collapsible portion 28, and the second groove 38 is disposed between the collapsible portion 28 and the second portion 26. The first and second grooves 36, 38 are configured to act as living hinges as the collapsible portion 28 is collapsed. In this regard, the first and second grooves 36, 38 can have a reduced thickness relative to the remainder of the body 12. In addition, the cross-sections of the first and second grooves can be V-shaped.

To adjust the height of the liner assembly 10, a downward force may be applied to the closed top 14 of the body 12 as the flange 18 is supported. As the downward force is applied, the first portion 24 of the body 12 moves downward relative to the second portion 26 of the body 12. In addition, the collapsible portion 28 rolls inward on itself in a direction A, as shown in FIG. 3, and the collapsible portion 28 becomes tapered inward from its lower end to its upper end, as shown in FIG. 1. If sufficient force is applied, the collapsible portion 28 continues to rotate in the direction A until the collapsible portion 28 is sandwiched between the exterior surface of the first portion 24 and the interior surface of the second portion 26, as shown in FIG. 6. At that point, the collapsible portion 28 is fully collapsed, and the height H of the liner assembly 10 is at its minimum.

In various implementations, the recessed light 100 may include a plurality of collapsible portions. For example, the recessed light may include 3, 6, 9, or more collapsible portions. The collapsible portions may collapse together in a telescoping manner. As discussed above, the body 12 may taper inward at an angle from its lower end to its upper end when the collapsible portions are fully unfolded. This angle may be increased as the number of collapsible portions is increased.

Figure 7:
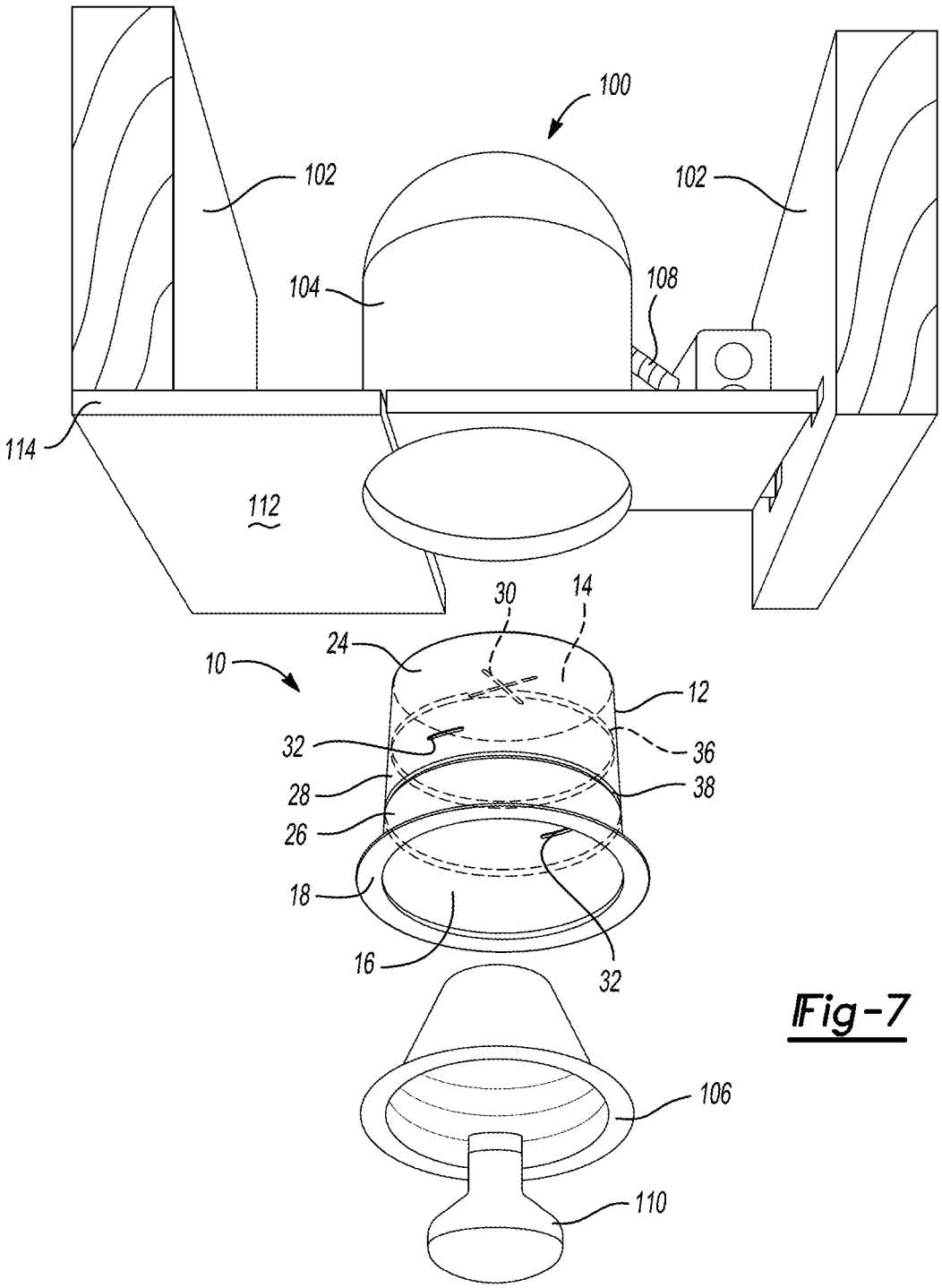
FIG. 7 is a perspective view illustrating a method of installing the liner assembly of FIG. 1 according to the principles of the present disclosure.

Referring now to FIG. 7, a recessed light 100 is shown mounted between two ceiling joists 102. The recessed light 100 includes a housing 104 and a trim ring 106. The housing 104 includes wiring 108 and a light bulb socket (not shown) that hold a light bulb 110 within the housing 104 and supply power to the light bulb 110. The trim ring 106 may be fixed to the housing 104 using trim mounting hardware such as coil springs (not shown) that bias the trim ring 106 against an underside surface 112 of a ceiling 114.

To install the liner assembly 10, power supplied to the recessed light 100 may be interrupted at a circuit breaker (not shown). Then, the light bulb 110 and the trim ring 106 may be removed from the recessed light 100. In some cases, it may be necessary to detach the light bulb socket and wiring from the trim ring 106 in order to fully disassemble the trim ring 106 from the housing 104.

Next, the punch-out portion 30 in the closed top 14 of the liner assembly 10 may be punched through. Then, the liner assembly 10 may be positioned below the housing 104, and the light socket and associated wiring may be pulled through the punch-out portion 30. The size of the punch-out portion 30 can be just large enough to pull the light socket through the body 12. Alternatively, depending on the material of the body 12, the size of the punch-out portion 30 can be smaller than the light socket since the material may stretch. For example, the body 12 may stretch if the body 12 is formed from liquid silicon rubber having a durometer within a certain range, but the body 12 may not stretch if the body 12 is formed from nylon using vacuum forming. As discussed above, instead of forming the body 12 to define the punch-out portion 30, one or more slits may be cut in the closed top 14 of the body 12 and the sidewall 13 of the body 12. The slits may be cut at points that approximate where the wiring 108 and the trim mounting hardware enter the housing 104.

Once the light socket and wiring is pulled through the punch-out portion 30, one of the body sealing gaskets 22 may be attached to the punch-out portion 30 and the liner assembly 10 may be inserted into the recessed light 100. The locations of the punch-out portions 32 required to attach the trim ring 106 to the housing 104 may then be determined, and those punch-out portions 32 may be punched through. If the body 12 is formed without the punch-out portions 32, any slits or perforations required to attach the trim ring 106 to the housing 104 may be marked. The slits may then be cut to accommodate mounting hardware for the trim ring 106. The height of the liner assembly 10 may be decreased as needed by compressing the collapsible portion 28 of the body 12.

The punch-out portions 32 may then be pushed over the trim mounting hardware if needed, and the body sealing gaskets 22 can be attached to the punch-out portions 32. Backing material may then be pulled off the flange sealing gasket 20, and the flange sealing gasket 20 can be pressed firmly against the underside surface 112 of the ceiling 114. The trim ring 106 may then be reassembled to the housing 104, and the light bulb 110 can be reinstalled in the recessed light 100. Power may then be supplied to the recessed light 100, and operation of the light bulb 110 can be verified.

The liner assembly 10 is configured to be mounted within the recessed light 100 without using mounting hardware such as brackets and/or fasteners. Since the body 12 and the flange 18 can be formed from a relatively lightweight material such as polymer, the flange sealing gasket 20 is sufficient to attach the flange 18 to the underside surface 112 of the ceiling 114 to secure the body 12 within the recessed light 100. In addition, although the body 12 can be formed from a flexible material such as polymer, the body 12 is sufficiently stiff to maintain its shape once adjusted to a desired height. In this regard, the first and second grooves 36 and 38 can act as stiffening ribs that stiffen the body 12.

Before installing the liner assembly 10, one may determine whether a particular light fixture allows excessive air movement between conditioned and unconditioned spaces within a building. In one example, a fixture that has a leak rate of greater than 2 cubic feet per minute at 75 pascals of pressure may be deemed 'leaky'. A measurement may be performed during a home energy audit. A typical audit includes depressurizing a home using a blower door or existing fans inside the home that draw air through building envelope perforations such as recessed light fixtures. Once a particular recessed light is determined to be 'leaky', as indicated by excessive air movement coming from the fixture, the liner assembly 10 may be installed using the method described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A liner assembly for a recessed light, the liner assembly comprising:

a hollow body configured to fit within the recessed light to prevent airflow through the recessed light, the body having an open bottom, a closed top, and a sidewall extending between the open bottom and the closed top;

an annular flange connected to the body and extending around the open bottom of the body; and a flange sealing gasket configured to:

attach the flange to an underside surface of a ceiling to secure the body within the recessed light; and provide a seal between the flange and the underside surface of the ceiling, wherein the sidewall of the body includes a collapsible portion for adjusting the height of the body.

2. The liner assembly of claim 1, wherein the flange sealing gasket is coated with an adhesive so that one side of the flange sealing gasket adheres to the flange while the other side of the flange sealing gasket adheres to the underside surface of the ceiling.

3. The liner assembly of claim 1, wherein the body and the flange are unitarily formed.

4. The liner assembly of claim 1, wherein the body and the flange are formed from a high temperature resistant material.

5. The liner assembly of claim 4, wherein the body and the flange are formed from polymer.

6. The liner assembly of claim 1, wherein the body has a frustum conical shape.

7. The liner assembly of claim 1, wherein at least one of the closed top of the body and the sidewall of the body defines a punch-out portion configured to be punched through without using a cutting tool.

8. The liner assembly of claim 7, wherein the punch-out portion includes a slit that is integrally formed into the body.

9. The liner assembly of claim 7, further comprising a body sealing gasket configured to seal the punch-out portion after an object is passed through the punch-out portion.

10. The liner assembly of claim 9, wherein the body sealing gasket is coated with adhesive.

11. A liner assembly for a recessed light, the liner assembly comprising:

a hollow body configured to fit within the recessed light to prevent airflow through the recessed light, the body having an open bottom, a closed top, and a sidewall extending between the open bottom and the closed top, the sidewall defining a first punch-out portion configured to be punched through without using a cutting tool; and an annular flange connected to the body and extending around the open bottom of the body.

12. The liner assembly of claim 11, wherein the first punch-out portion includes perforations.

13. The liner assembly of claim 11, wherein the closed top of the body defines a second punch-out portion configured to be punched through without using a cutting tool.

14. The liner assembly of claim 13, further comprising body sealing gaskets configured to seal the first and second punch-out portions after an object is passed through the first and second punch-out portions.

15. The liner assembly of claim 14, wherein the body sealing gaskets are coated with adhesive.

16. A liner assembly for a recessed light, the liner assembly comprising:

a hollow body configured to fit within the recessed light to prevent airflow through the recessed light, the body having an open bottom, a closed top, and a sidewall extending between the open bottom and the closed top, the sidewall including a collapsible portion for adjusting the height of the body; and a flange connected to the body and disposed about the open bottom of the body.

17. The liner assembly of claim 16, further comprising a flange sealing gasket configured to provide a seal between the flange and an underside surface of a ceiling.

18. The liner assembly of claim 16, wherein the flange is an annular flange that extends around the open bottom of the body.

* * * * *